US005601333A

United States Patent [19]

Bostrom et al.

[11] Patent Number: 5,601,333

[45] Date of Patent: Feb. 11, 1997

[54] SEAT RETENTION SYSTEM

[75] Inventors: John M. Bostrom, Waterford; Douglas P. Gennrich, Cudahy, both of Wis.

[73] Assignee: H. O. Bostram Company, Inc., Waukesha, Wis.

[21] Appl. No.: 526,158

[22] Filed: Sep. 11, 1995

[51] Int. Cl.[6] ..... A47C 31/00

[52] U.S. Cl. ..... 297/218.5; 297/218.1; 297/218.3; 297/452.59

[58] Field of Search ..... 297/218.5, 218.1, 297/218.2, 218.3, 452.59

[56] References Cited

U.S. PATENT DOCUMENTS

| | | | |
|---|---|---|---|
| 659,251 | 10/1900 | Nerad . | |
| 2,151,628 | 3/1939 | Van Derveer . | |
| 2,715,434 | 8/1955 | Lukens . | |
| 3,102,755 | 9/1963 | Wilfert | 297/218.1 X |
| 3,423,775 | 1/1969 | Cockerill . | |
| 3,671,984 | 6/1972 | Ambrose . | |
| 3,747,178 | 7/1973 | Harder, Jr. . | |
| 3,758,159 | 9/1973 | Morris . | |
| 3,904,242 | 9/1975 | Koepke et al. . | |
| 3,915,493 | 10/1975 | Brown . | |
| 4,169,627 | 10/1979 | Murphy et al. . | |
| 4,396,226 | 8/1987 | Haack . | |
| 4,408,797 | 10/1983 | Franck et al. . | |
| 4,564,239 | 1/1986 | Akimoto | 297/452.59 |
| 4,603,907 | 9/1986 | Witzke . | |
| 4,624,503 | 11/1986 | Kazunori | 297/452.59 X |
| 4,723,816 | 2/1988 | Selbert et al. . | |
| 4,742,984 | 5/1988 | Cote et al. . | |
| 4,892,355 | 1/1990 | Fend . | |
| 5,503,454 | 4/1996 | Sakamoto | 297/218.1 |

FOREIGN PATENT DOCUMENTS

| | | | |
|---|---|---|---|
| 122245 | 10/1984 | European Pat. Off. | 297/218.3 |
| 1279402 | 11/1961 | France | 297/218.5 |
| 1654287 | 3/1971 | Germany | 297/452.59 |
| 2928473 | 1/1981 | Germany | 297/218.5 |
| 3732836 | 12/1988 | Germany | 297/218.3 |
| 855623 | 12/1960 | United Kingdom | 297/218 |

*Primary Examiner*—Peter R. Brown
*Assistant Examiner*—Rodney B. White
*Attorney, Agent, or Firm*—Andrus, Sceales, Starke & Sawall

[57] ABSTRACT

A seat retention system comprises a framework including a rigid, substantially U-shaped member having a pair of parallel, spaced apart legs and a bight section therebetween. The framework also includes a plurality of spring elements extending between the legs. A cushion assembly includes a cushion having an upstanding sidewall, a liner disposed on one side of the sidewall, a covering material secured to the liner, and a mounting strip disposed on the other side of the sidewall. The mounting strip is secured to the sidewall and the liner. A plurality of retaining strips has a first portion slidably mounted on the mounting strip and secured thereto, and a second portion engageable in a snap fit with the U-shaped member. Certain of the retaining clips are mounted in one orientation on the legs of the U-shaped member and between the spring elements. Certain other of the retaining clips are mounted in an orientation reversed from the one orientation on the bight section of the U-shaped member.

11 Claims, 2 Drawing Sheets

FIG. 1
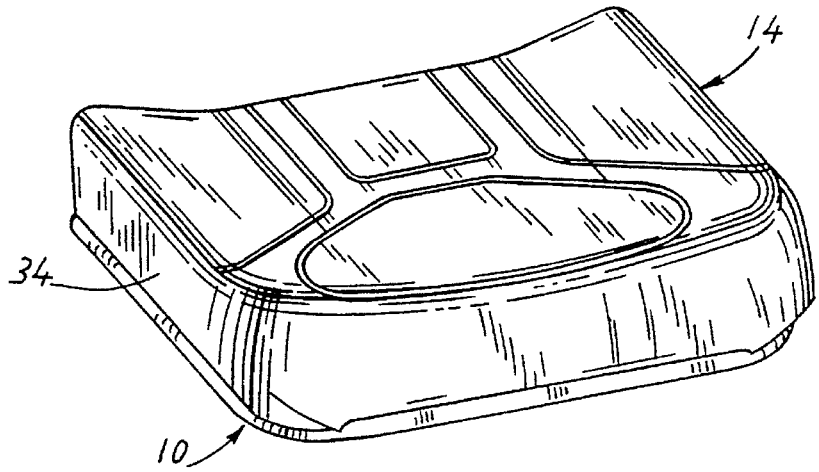
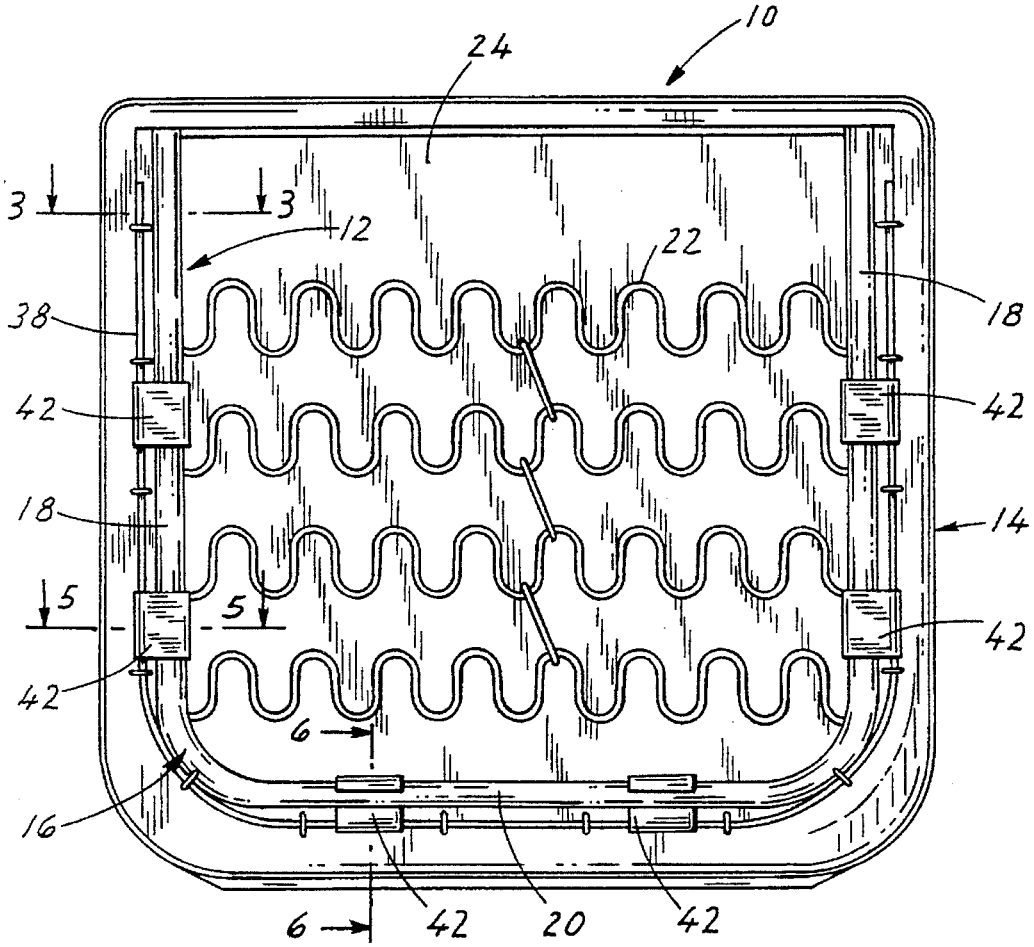
FIG. 2

FIG. 3
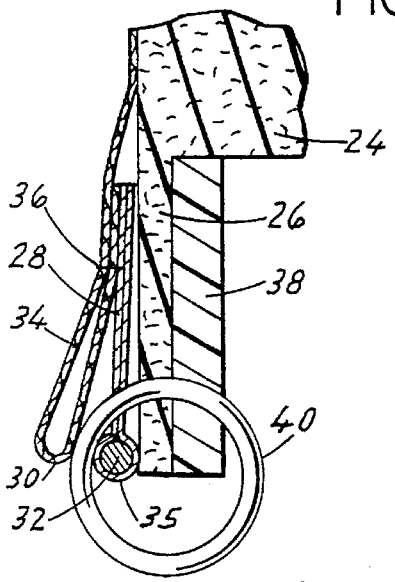
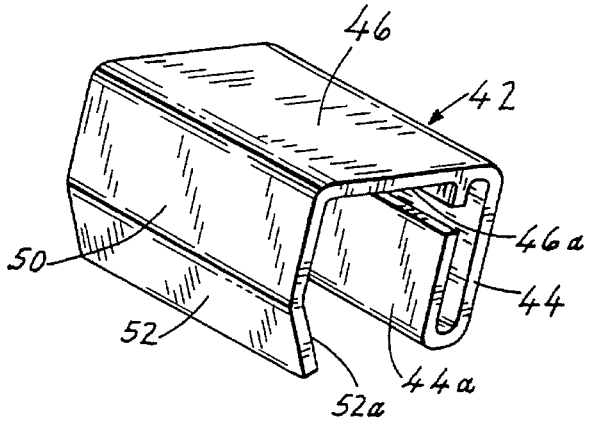
FIG. 4
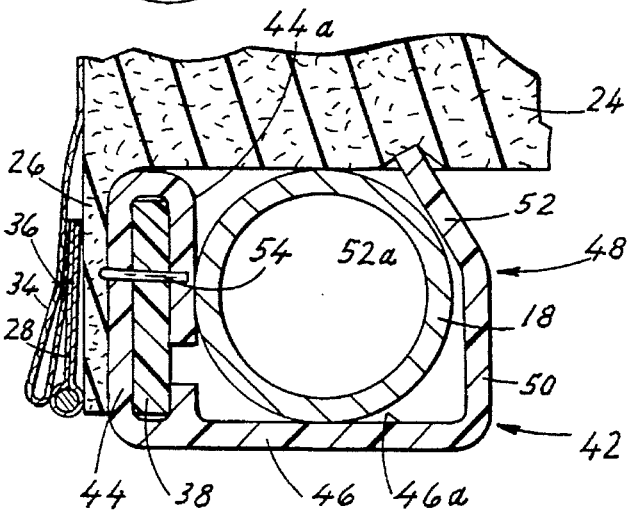
FIG. 5
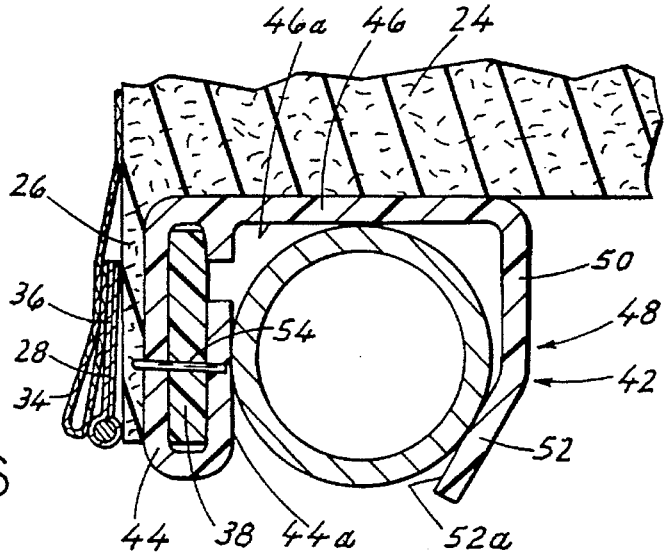
FIG. 6

SEAT RETENTION SYSTEM

FIELD OF THE INVENTION

This invention relates broadly to a retention system for securing seat components such as seat backs and/or cushions to associated frameworks, and is more particularly concerned with such a system which is especially adapted for use with vehicle seats.

BACKGROUND OF THE INVENTION

Vehicle seats conventionally include some type of retention device for securing seat components such as a seat cushion and/or a seat back to a rigid, spring-type framework. During manufacture and assembly, a covering material of one or more layers is stretched around a urethane foam pad or the like to form a cushion assembly which must be effectively secured to a framework to be fixed in a vehicle. Because vehicle seats are subjected to a great deal of wear and abuse, their construction must be sturdy and extremely durable. For safety reasons, it is important that there be a secure anchorage between the covered cushion and its respective framework. It is also important, however, that the retention system provide a method of quickly and simply enabling the connection between the covered cushion and its framework so that the cushions can be easily installed or replaced.

In particular, rugged applications, such as found in industrial and emergency vehicles, cause seat cushions and backs to wear to such an extent that they must be replaced or repaired. Until now, one had to purchase an entirely new seat or employ an upholsterer to fix the damaged or worn covered cushion. In many instances, it is difficult to access the fastening system on such a worn or damaged seat cushion resulting in higher maintenance expenses. It is preferable and more cost effective for an end user to utilize a retention system which will allow a person to easily replace a covered cushion on a framework in a manner which will maintain the integrity of the original seat design in the vehicle as a whole. It is also desirable to provide a retention system which relies upon a locking, snap fit, retainer clip to secure the covered cushion on its framework regardless of the weight placed upon the seat. It is likewise desirable to be able to snappingly disconnect from and reattach a covered cushion assembly to the framework with a minimum of effort and without any tools.

One of the shortcomings in using a retaining clip to snappingly attach a seat cushion to a framework is that only a limited amount of gripping force is available to retain the seat cushion on the framework. This means that a significant or unbalanced load applied on the seat cushion could potentially dislodge the connection to the framework. Accordingly, it is within the purview of the invention to provide a retention system which will exhibit the desirable properties of maintaining a secure engagement between the seat cushion and framework at all times.

SUMMARY OF THE INVENTION

The present invention advantageously provides a seat retention system in which a covered cushion assembly is easily and securely attached to a seat framework by means of the structure and orientation of a resilient clip.

In one aspect of the invention, a seat retention system comprises a framework, a cushion assembly, and a retaining clip slidably mounted on the cushion assembly and secured thereto, the retaining clip also being engageable in a snap fit with the framework.

Another aspect of the invention contemplates an apparatus for attaching a cushion assembly to a framework. The framework includes a rigid, substantially U-shaped member having a pair of parallel, spaced apart legs and a bight section therebetween. The framework also includes a plurality of spring elements extending between the legs. The cushion assembly includes a cushion having an upstanding sidewall, a liner disposed on one side of the sidewall, a covering material secured to the liner, and a mounting strip disposed on the other side of the sidewall. The mounting strip is secured to the sidewall and the liner. Each of a plurality of retaining clips has a first portion slidably mounted on the mounting strip and secured thereto and a second portion engageable in a snap fit with the U-shaped member. Certain of the retaining clips are mounted in one orientation on the legs of the U-shaped member and between the spring elements, and certain other of the retaining clips are mounted in an orientation reversed from the one orientation on the bight section of the U-shaped member.

Another aspect of the invention includes a method for attaching a cushion to a framework, the method comprising the steps of; a) providing a covering material, a cushion having an upstanding sidewall and a framework; b) placing the covering material around the cushion so that the upstanding wall lies within the periphery of the covering material; c) providing an elongated, flexible mounting strip and a plurality of slidable, resilient retaining clips; d) sliding and securing the retaining clips at discrete positions on the flexible mounting strip; e) placing the flexible mounting strip adjacent the upstanding wall; f) securing the flexible mounting strip to the upstanding sidewall in the covering material; and g) snap fitting the retaining clips to the framework.

BRIEF DESCRIPTION OF THE DRAWINGS

The invention will become better understood by reference to the following detailed description of the preferred exemplary embodiment when read in conjunction with the appended drawing wherein like numerals denote like elements; and FIG. 1 is an isometric view of seat cushion embodying the present invention;

FIG. 2 is a bottom view of the cushion shown in FIG. 1;

FIG. 3 is a cross-sectional view taken on line 3—3 of FIG. 2;

FIG. 4 is a isometric view of the retaining clip embodying the present invention;

FIG. 5 is a cross-sectional view taken on line 5—5 of FIG. 2; and FIG. 6 is a cross-sectional view taken on line 6—6 of FIG. 2.

DETAILED DESCRIPTION OF THE PREFERRED EMBODIMENT

Referring now to FIGS. 1 and 2, the seat retention system embodying the present invention is generally identified by the numeral 10, and includes a seat framework 12 on which a cushion assembly 14 is secured.

Framework 12 comprises a rigid, substantially U-shaped, tubular support member 16 of metallic construction having a pair of spaced apart, parallel legs 18 connected by a bight section 20. Tubular member 16 is circular in cross-section and has a constant diameter throughout its length. Framework 12 also includes a plurality of conventional spring elements 22 extending between the legs 18.

As best seen in FIGS. 3, 5 and 6, cushion assembly 14 includes a urethane foam cushion 24 having an upstanding sidewall 26. A liner 28 in the form of a loop 35 carrying a reinforcing blister cord 32 is disposed on one side of and directly adjacent the sidewall 26. A covering material 34 also in the form of a loop 30 is wrapped about the foam cushion 24 and is secured to the liner loop 35 by stitching 36 or the like on a side opposite the sidewall 26. An elongated, flexible mounting strip 38 constructed preferably of plastic is disposed on the other side of the sidewall 26 and is secured to the bottom of the sidewall 26 and the liner loop 35 by a series of C-clips 40.

According to the invention, a plurality of resilient retaining clips 42 preferably of plastic material are slidably mounted on the aforedescribed cushion assembly 14 and engageable in a snap fit with the framework 12.

More particularly, as illustrated in FIG. 4, each retaining clip 42 is integrally formed with an envelope 44 defining a first bearing surface 44*a*. Retaining clip 42 also has a flat, generally horizontal planar surface 46 extending from the envelope 44 and defining a second bearing surface 46*a*. A spring arm 48 extending from surface 46 has a flat, generally vertically planar surface 50 merging into an inwardly directed planar surface 52 defining a third bearing surface 52*a*. Envelope 44, surface 46, and spring arm 48 collectively define an internal space for retaining U-shaped member 16 against the respective first, second and third bearing surfaces 44*a*, 46*a*, 52*a*. In the preferred embodiment, retaining clip 42 is typically formed such that it resembles the letter G in cross-section. However, it is to be noted that this particular shape is not critical, and that other shapes may be used as long as their structure and function fall within the scope of the attached claims.

The method for attaching the cushion assembly 14 to the framework 12 commences with placing the covering material 34 around the cushion 24 so that the upstanding sidewall 26 lies within the periphery of the covering material 34. In the preferred embodiment, inner liner 35 is placed adjacent to an inside surface of covering material 34 and stitched thereto at 36. In a separate operation, the envelope portions 44 of a series of retaining clips 42 are slidably mounted on mounting strip 38 and secured thereto such as by staples 54 at strategic, discrete locations and in certain orientations as will be more fully appreciated hereafter. The next step involves placing the mounting strip 38 with attached clips 42 adjacent the upstanding sidewall 26 of the cushion 24. Once this alignment is made, mounting strip 38 is secured to the bottom of sidewall 26, covering material 34 and liner 28 by C-clips 40 inserted preferably by a power tool (not shown). The last step simply entails aligning the legs 18 of U-shaped member 16 beneath the appropriate clips 42 and the bight portion 20 of U-shaped member 16 over the appropriate clips 42. One then applies a downward force on the legs 18 and a downward force on the bight portion 20 to snap framework 12 to cushion assembly 14. Such downward forces will cause tubular member 16 to initially engage first and third bearing surfaces 44*a*, 52*a*, the latter surface of spring arm 48 temporarily deflecting to allow the member 16 to be captured against surfaces 44*a*, 46*a*, 52*a*.

It has been discovered that the clips 42 engaging the legs 18 of framework 12 provide for the easiest application and most positive securement by locating them in discrete positions between the spring elements 22 of the framework 12. It has also been found most advantageous to orient these clips 42 in a position with the horizontal planar surface 46 facing downwardly away from the cushion 24 as shown in FIG. 5. Clips 42 engaging the bight section 20 are snapped on at generally equidistant locations in a reverse orientation from the clips 42 on the legs 18. That is, the planar surface 46 lies adjacent the bottom of cushion 24 as depicted in FIG. 6. A reverse orientation of the clips 42 when subjected to the weight of a seat's occupant will act downwardly on planar surface 46 and cause spring arm 48 to move inwardly on tubular member 16 providing a solid anchorage.

It should be appreciated that the seat retention system 10 provides a secure engagement between the cushion assembly 14 and framework 12 at all times, yet permits release of the cushion assembly 14 by simply applying an outward force to the spring arms 48 of the clips 42 on bight section 20. In other words, instead of replacing an entire seat assembly or engaging the services of an upholsterer to fix a damaged or worn seat, one is able to easily disconnect and replace a cushion assembly 14 with a minimum of effort, without any tools, and with reduced cost.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

We claim:

1. Apparatus for attaching a cushion assembly to a framework, said apparatus comprising:

the framework including a rigid, substantially U-shaped, tubular member, said U-shaped, tubular member having a top surface and a bottom surface and including a pair of parallel, spaced apart legs and a bight section therebetween defining the front of the framework, the framework also including a plurality of spring elements extending between said legs;

the cushion assembly including a generally horizontally disposed cushion having an upstanding sidewall provided with an inner side and an outer side, a liner disposed on the outer side of said sidewall, a covering material secured to said liner and a mounting strip disposed on the inner side of said sidewall, said mounting strip being secured to said sidewall and said liner, and a plurality of retaining clips, each of said clips having a first portion slidably mounted on said mounting strip and secured thereto and a second portion engageable in a snap-fit with said U-shaped, tubular member beneath said cushion, each retaining clip being integrally formed with an envelope portion defining a vertically extending bearing surface, a flat, generally horizontal planar surface extending from the envelope portion and defining a horizontally extending bearing surface, and a resilient spring arm having a flat, generally vertical planar surface merging into an inwardly directed planar surface defining an angularly extending bearing surface, certain of said clips being mounted in one orientation on said legs of said U-shaped, tubular member and between said spring elements with said horizontal planar surface disposed along the bottom surface of said U-shaped, tubular member and spaced from said cushion, and certain other of said retaining clips mounted in an orientation reversed from said one orientation on said bight section of said U-shaped, tubular member with said horizontal planar surface disposed between said cushion and said top surface of said U-shaped, tubular member, a downward force applied to said cushion being transmitted to said horizontal planar surface of said retaining clip having said one orientation causing said spring arm to tightly engage said top surface of said U-shaped, tubular member along said legs and a downward force applied to said cushion being transmitted to said horizontal planar surface of said retaining clip of said reverse orientation causing said spring arm to tightly engage the bottom surface of said U-shaped, tubular member along the front of the framework so as to prevent dislodging the cushion assembly from the framework irregardless of the load applied to said cushion.

2. The apparatus of claim 1, wherein said U-shaped member is an elongated tube having a constant diameter throughout its length.

3. The apparatus of claim 1, wherein said mounting strip is an elongated piece of flexible plastic material.

4. The apparatus of claim 1, wherein said cushion is comprised of a foam material.

5. The apparatus of claim 1, wherein each of said retaining clips is substantially G-shaped in cross-section.

6. The apparatus of claim 1, wherein said mounting strip is disposed along and outside of said U-shaped member.

7. The apparatus of claim 1, wherein said U-shaped member is circular in cross-section.

8. The apparatus of claim 1, wherein said envelope portion, said horizontal planar surface and said spring arm form an internal space for retaining said U-shaped, tubular member against said vertically extending bearing surface, said horizontally extending bearing surface and said angularly extending bearing surface.

9. A method of attaching a cushion to a tubular framework, said method comprising the steps of:

a) providing a covering material having a periphery, a cushion having an upstanding wall, and a tubular framework having a top surface and a bottom surface;

b) placing the covering material around the cushion so that the upstanding wall lies within the periphery of the covering material;

c) providing an elongated flexible mounting strip and a plurality of slidable resilient retaining clips, each of said clips being integrally formed with a vertically extending bearing surface, a horizontally extending bearing surface and an angularly extending bearing surface;

d) sliding and securing the retaining clips at discrete positions on the flexible mounting strip by positioning certain retaining clips in one orientation with said horizontally extending bearing surface disposed along the bottom surface of the framework and positioning certain other of the retaining clips in a reverse orientation with said horizontally extending bearing surface disposed between the cushion and the top surface of the tubular framework;

e) placing the flexible mounting strip adjacent the upstanding wall;

f) securing the flexible mounting strip to the upstanding sidewall and the covering material; and g) snap fitting the retaining clips to the tubular framework such that each of said angularly extending bearing surfaces will be forced into tight engagement with the tubular framework.

10. The method of claim 9, wherein the step of providing a covering material includes attaching an inner liner to the covering material.

11. Apparatus for attaching a cushion assembly to a framework, said apparatus comprising:

the framework including a rigid, substantially U-shaped, tubular member;

the cushion assembly including a generally horizontally disposed cushion having an upstanding sidewall provided with an inner side and an outer side, and a mounting strip disposed on the inner side of said sidewall, said mounting strip being secured to said sidewall; and a plurality of retaining clips detachably securing the cushion assembly to the framework, each of said clips having a first portion slidably mounted on said mounting strip and secured thereto and a second portion engageable in a snap-fit with said tubular member beneath said cushion, each retaining clip being integrally formed with an envelope portion substantially surrounding said mounting strip and defining a vertically extending bearing surface engageable with a first peripheral portion of said tubular member, a flat, generally horizontal planar surface extending from the envelope portion and defining a horizontally extending bearing surface engageable with a second peripheral portion of said tubular member, and a resilient spring arm having a flat, generally vertical planar surface extending from the horizontally extending bearing surface and merging into an inwardly directed planar surface defining an angularly extending bearing surface engageable with a third peripheral portion of said tubular member.

* * * * *

UNITED STATES PATENT AND TRADEMARK OFFICE

CERTIFICATE OF CORRECTION

PATENT NO. : 5,601,333

DATED : February 11, 1997

INVENTOR(S) : Bostrom et al.

It is certified that error appears in the above-indentified patent and that said Letters Patent is hereby corrected as shown below:

ON THE TITLE PAGE:

Item[73] Assignee, delete "Bostram" and substitute therefore ---Bostrom---.

Signed and Sealed this

Thirteenth Day of May, 1997

Bruce Lehman

*Attest:*

BRUCE LEHMAN

*Attesting Officer*

*Commissioner of Patents and Trademarks*